US006719591B1

(12) United States Patent
Chang

(10) Patent No.: US 6,719,591 B1
(45) Date of Patent: Apr. 13, 2004

(54) SATA INTERFACE RELAY CONNECTOR AND ITS APPLICATION

(76) Inventor: Cheng Chun Chang, 11F-2, No. 11, Lane 202, Jing-Shing Road, Wen-Shan DT., Taipei (TW)

( * ) Notice: Subject to any disclaimer, the term of this patent is extended or adjusted under 35 U.S.C. 154(b) by 0 days.

(21) Appl. No.: 10/425,264

(22) Filed: Apr. 29, 2003

(30) Foreign Application Priority Data

Mar. 28, 2003 (TW) ..... 92204900 U
Mar. 28, 2003 (TW) ..... 92204901 U

(51) Int. Cl.[7] ..... H01R 25/00
(52) U.S. Cl. ..... 439/638
(58) Field of Search ..... 439/638, 639, 439/653, 651, 652, 654

(56) References Cited

U.S. PATENT DOCUMENTS 6,331,122 B1 * 12/2001 Wu ..... 439/567
6,402,552 B1 * 6/2002 Wagner ..... 439/606
6,494,749 B1 * 12/2002 Chang ..... 439/701
6,565,383 B1 * 5/2003 Wu ..... 439/567
6,575,783 B1 * 6/2003 Wu ..... 439/540.1
6,585,536 B1 * 7/2003 Wu ..... 439/358
6,585,537 B1 * 7/2003 Lee ..... 439/358
6,589,074 B1 * 7/2003 Wu ..... 439/540.1
6,589,077 B1 * 7/2003 Wu ..... 439/567
6,623,299 B1 * 9/2003 Liu ..... 439/604
6,648,676 B1 * 11/2003 Lee ..... 439/499
6,648,682 B1 * 11/2003 Wu ..... 439/567
6,648,695 B1 * 11/2003 Wu ..... 439/638

* cited by examiner

*Primary Examiner*—Ross Gushi
(74) *Attorney, Agent, or Firm*—Nelson A. Quintero

(57) ABSTRACT

The present invention discloses a SATA interface relay connector, comprising a signal section and a power supply section that comply with the SATA interface pin assignment on one side, and one side of the signal section is coupled to a signal cable and a signal connector is disposed at the end, and the other side of the power supply section is coupled to at least one power input connector. The relay connector further couples to the rear panel of an external frame to constitute a high-speed transmission mobile rack together with the enclosure.

9 Claims, 5 Drawing Sheets

SATA INTERFACE RELAY CONNECTOR AND ITS APPLICATION

BACKGROUND OF THE INVENTION

1. Field of the Invention

The present invention relates to a relay connector, more particularly to a SATA interface relay connector that provides a relay connection between an external device and a computer.

2. Description of the Related Art

The development of computer definitely brings us lots of convenience. Since computer software and hardware developers have been developing new products unceasingly, various computer peripherals have been introduced up to now.

As the computer application becomes more popular, the communications and multimedia applications of desktop computers and compact notebook computers utilize peripheral devices such as the 5.25-inch CD ROM, DVD ROM, CD-R, and CD-RW drives as well as mobile racks and interfaces such as the USB and IEEE 1394 (Fire Wire) interfaces for fast transmissions. Therefore, it is no longer a dream to use external enclosures for the connection of computers and peripheral devices.

In view of the requirements for a high-speed transmission, the Serial ATA (SATA) interface was developed with a fast signal transmission speed of up to 1.5 Gb/s, which is much faster than the IDE, USB, or 1394 interface transmission speed. For example, the prior-art IDE interface mobile rack has an external frame for receiving or detaching an enclosure, so that a data storage device of the enclosure such as a hard disk drive constitutes a connection or disconnection of the signal and power supply with the main computer system. Therefore, the external frame usually comes with a circuit board at its backside, a power input socket and a standard IDE interface connector respectively disposed at its outer sides, and a 50-pin external connector integrated with the foregoing signal and power supply on the inner sides by a circuit layout. The enclosure at the outer side of its back has an external connector connectible with the enclosure, and the inner side will separate the signal and power supply into a standard IDE interface connector and a power output socket. As we know, if the number of connecting points or relays is too large during the signal transmission process, it will deteriorate or delay the signals or even cause a transmission failure (i.e. system crash). In particular, most of the prior-art relay connectors have a circuit board with the signal conversion, integration, and input/output functions. Due to the factor of the circuit layout on the circuit board, it is difficult to cope with the stability required for the high-speed transmission, and thus the prior-art technology needs to be improved.

In view of the above description, the present inventor herein with many years of practical experience in the design, development, manufacturing and marketing of computer movable rack and external connecting device enhanced the design of the traditional relay connector that cannot stably perform high-speed transmissions due to the circuit board by performing a series of researches and developments and finally succeeded to invent the "SATA interface relay connector and its application" of the present invention.

SUMMARY OF THE INVENTION

The primary objective of the present invention is to provide a SATA interface relay connector, comprising a signal section and a power supply section that comply with the SATA interface pin assignments on one side; one side of the signal section is coupled to a signal cable and a signal connector is disposed at one end; and the other side of the power supply section is coupled to at least one power input connector.

The secondary objective of the present invention is to provide a SATA interface relay connector, wherein a power cable is connected between the power connector and the power supply section.

Another objective of the present invention is to provide a SATA interface relay connector, wherein the power connector a power input connector is a socket with the 12V, 5V, and ground lines respectively coupled to Pins 13th~15th, Pins 7th~9th, and Pins 4th~6th and Pins 10th~12th of said power supply section; and the other power input connector is a 3.3V socket coupling to Pins 1st~3rd of the power supply section.

A further objective of the present invention is to provide a SATA interface relay connector further comprising an external frame, and the relay connector is disposed at the rear panel of an external frame such that an enclosure can be moved into or out of the external frame to connect or disconnect the signal and/or power supply of a data storage device.

Another further objective of the present invention is to provide a SATA interface relay, wherein the enclosure has a through hole corresponding to the relay connector for passing the relay connector through the hole to connect the signal and power supply connectors of the data storage device.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
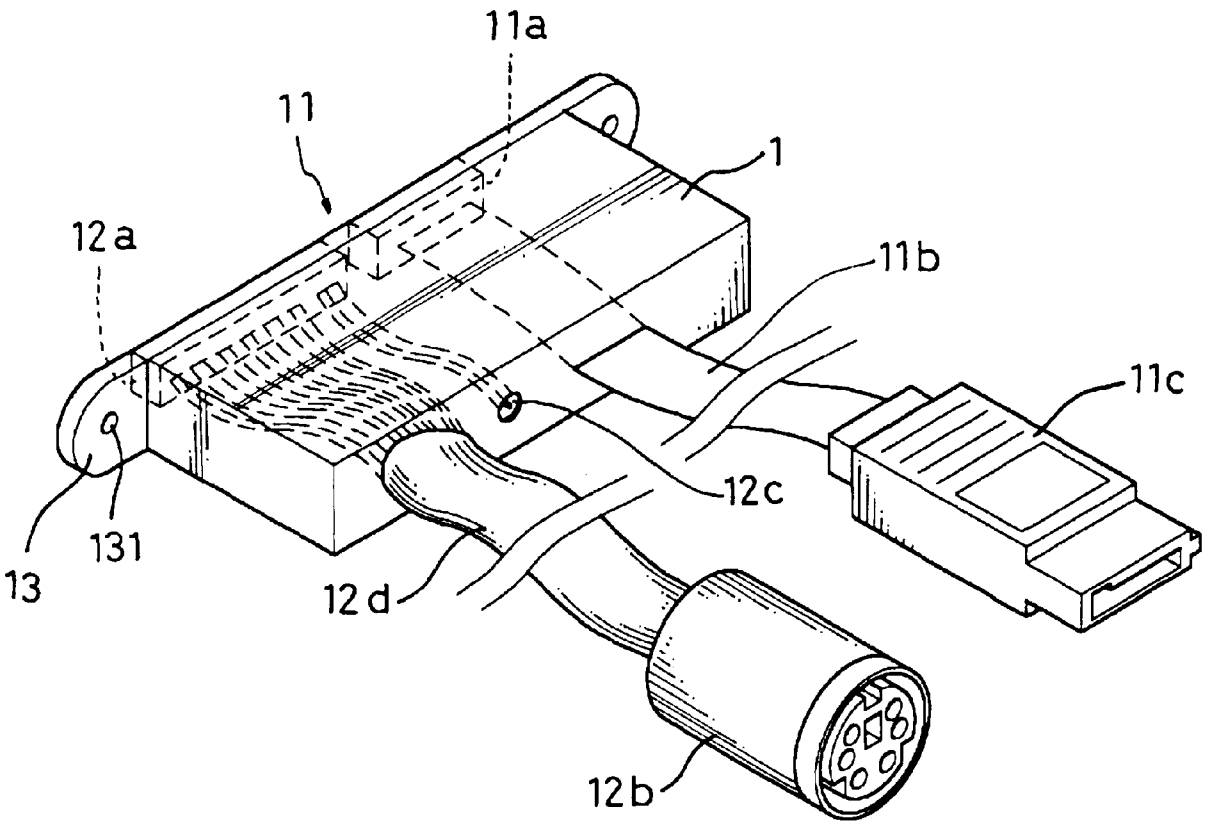
FIG. 1 is a perspective diagram of the relay connector of the present invention.

Refer to FIG. 1 for the present invention. A relay connector 1 is an object of a fixed shape, comprising a repeater connector 11 with a signal section 11*a* and a power supply section 12*a* that comply with the SATA interface pin assignments, and the signal section 11*a* and the power supply section 12*a* have a 7-pin terminal and a 15-pin terminal respectively. The signal section 11*a* and the power supply section 12*b* directly coupled to a signal cable 11*b* and at least one power input connector 12*b*, 12*c* at another side, such as two sockets: one with 12V and 5V and the other with 3.3V. The signal cable 11*b* has a signal connector 11*c* for connecting to the signals of the motherboard of the computer and the interface. card. The 12V, 5V, and ground lines of the power input connector 12*b* are coupled respectively to Pins 13th~15th, Pins 7th~9th, and Pins 4th~6th and Pins 10th~12th; the 3.3V of another power input connector 12*c* is coupled to Pins 1st~3rd of the power supply section 12*a* for supplying the direct current power to the external connecting device 2. Further, the power connector 12*b* and the power supply section 12*a* is connected by a power cable 12*d* to attain the same effect of obtaining electric power.

The advantages of the relay connector 1 reside on that there is only a signal cable 11*b* between the signal section 11*a* and the signal connector 11*c* for the connection, and there is no circuit board or contact point between the signal sections and the signal connector 11*c*. Therefore, it will not cause any slow-moving or delay situations during the high-speed transmission of signals.

Further, the relay connector 1 has a protruded ear 13 each on both sides, and a traditional connecting member such as a screw or a rivet is used to pass through the ear hole 131 to fix an external connecting device 2. However, the connecting method is not limited to the one disclosed above, but also includes a hook-up method or snap-in method for connecting the external connecting device 2.

Figure 2:
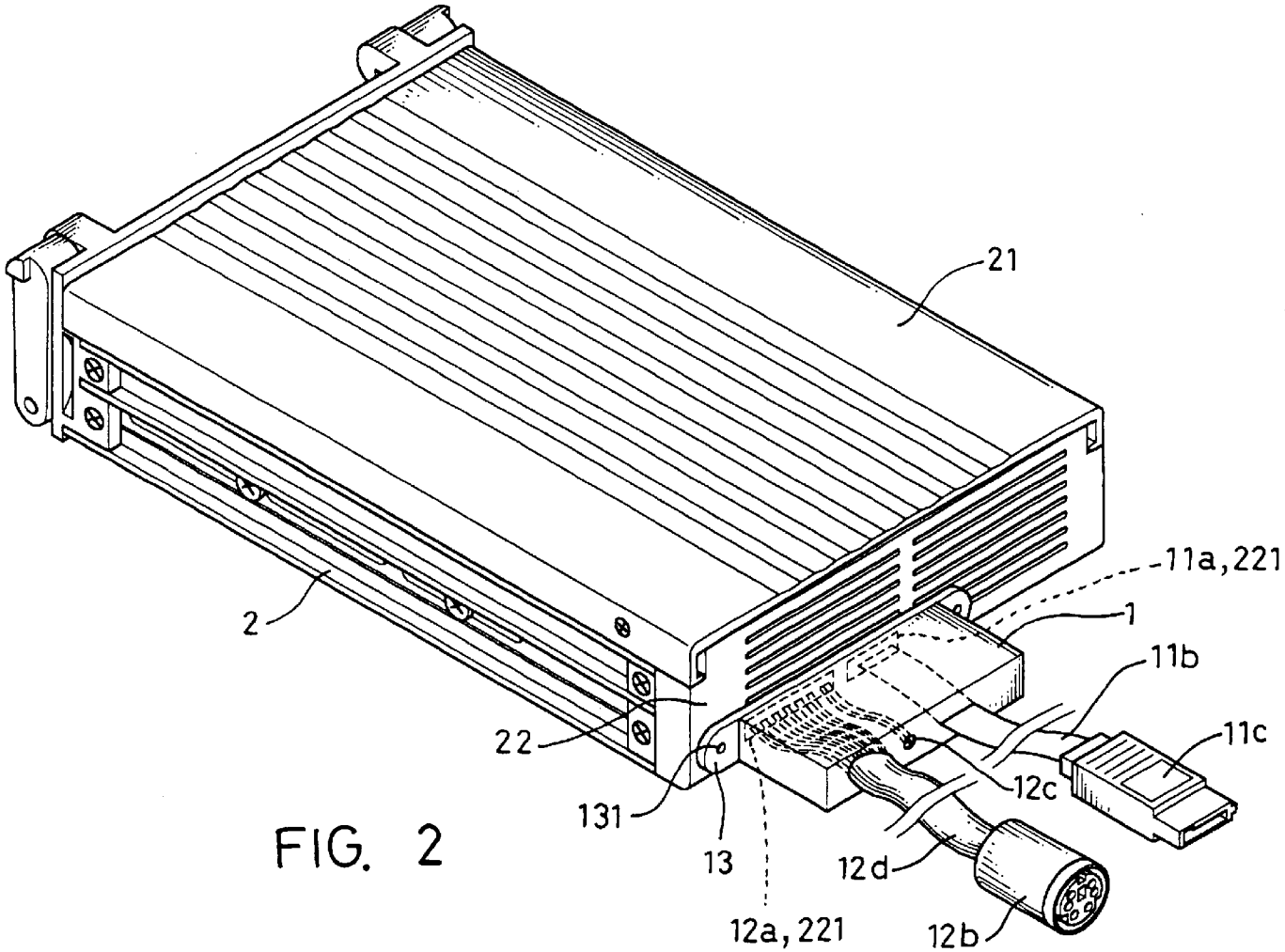
FIG. 2 is an illustrative diagram of the relay connector of the present invention being connected to an external connecting device.

In FIG. 2, the external connecting device 2 has a data storage device such as a SATA interface hard disk drive, optical disk drive, CD-ROM drive or even an enclosure of a movable rack installed in a housing 21, and a through hole 221 disposed at a position on the rear panel 22 corresponding to the signal and power connector of the data storage device for allowing the repeater connector 11 to pass through and connected to the signal and power connector to constitute the signal and/or power connection.

Figure 3:
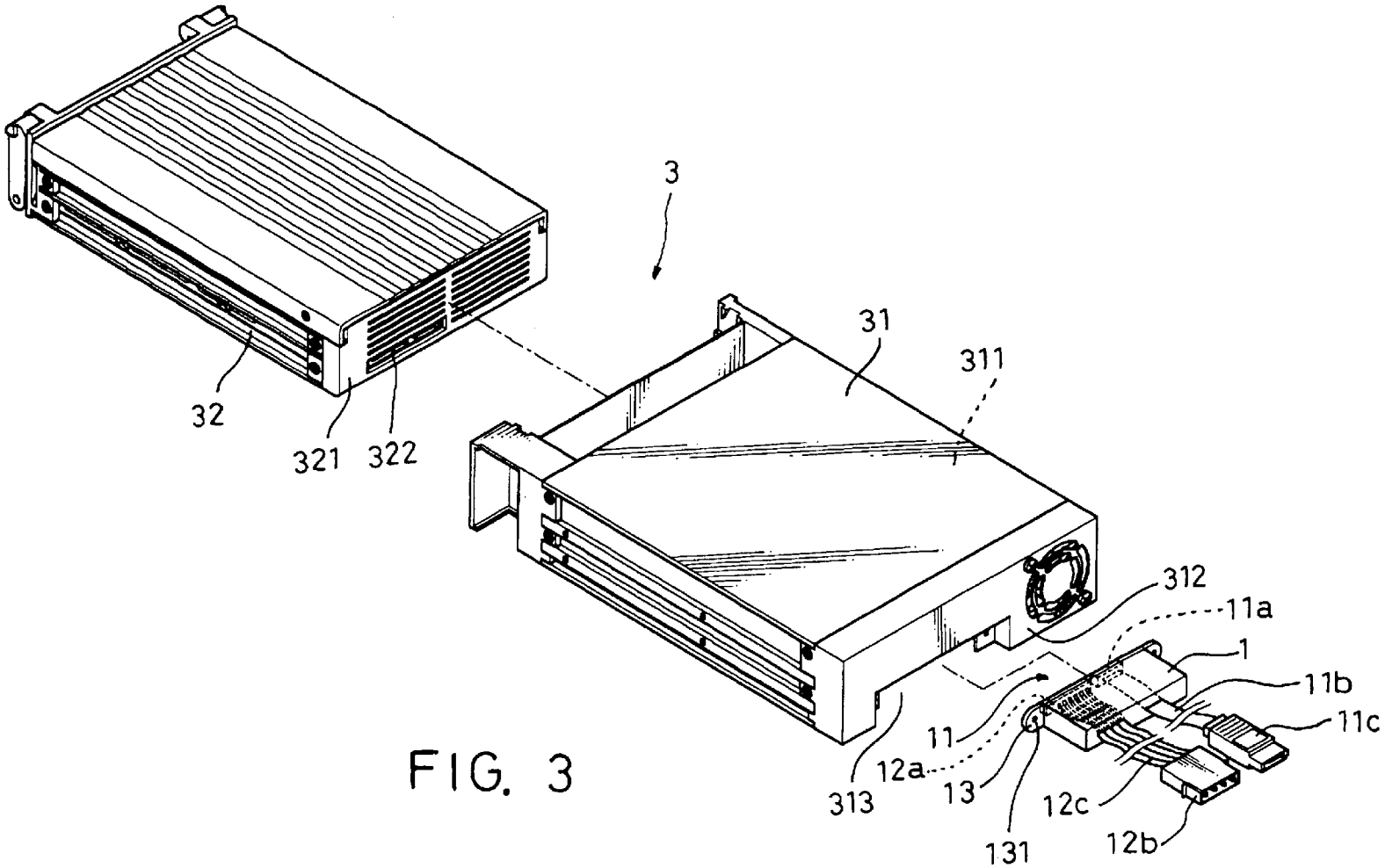
FIG. 3 is a perspective diagram of the relay connector of the present invention being applied on a movable rack.
Figure 4:
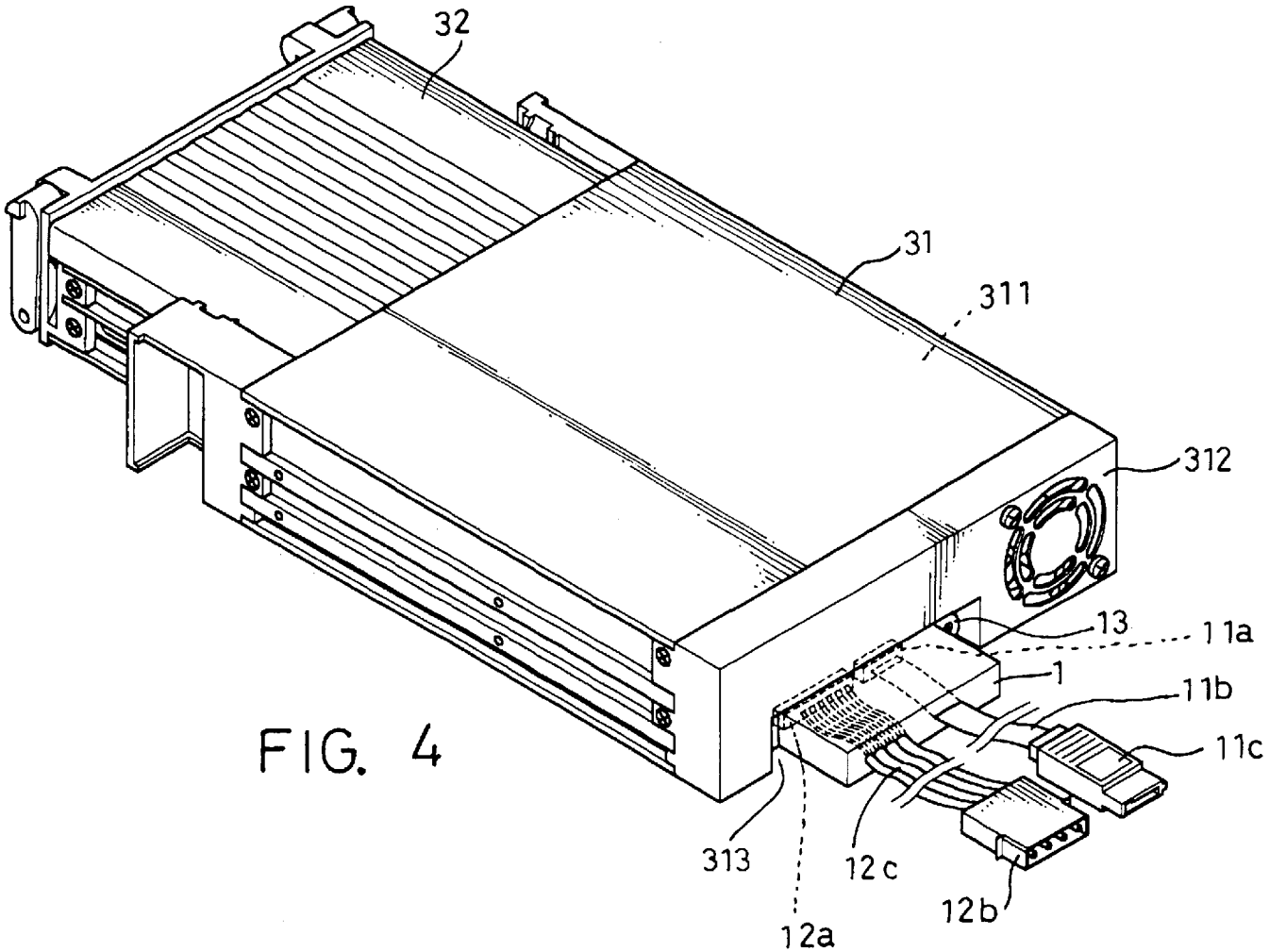
FIG. 4 is a perspective diagram of the assembled structure of FIG. 3.
Figure 5:
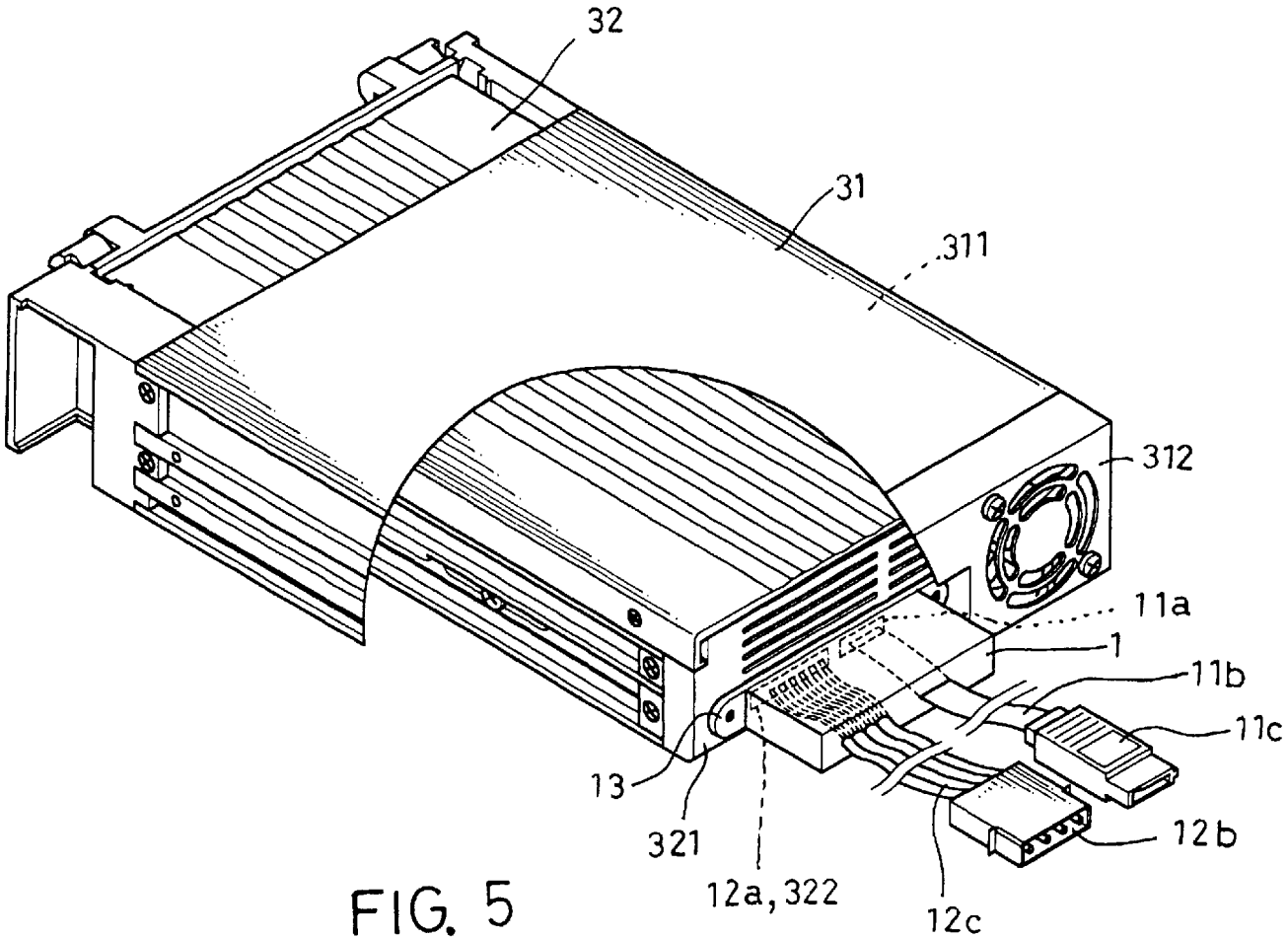
FIG. 5 is a sectional diagram of the assembled structure of FIG. 3

Please refer to FIGS. 3 to 5. In the figures, the relay connector 1 may be applied to a movable rack 3, which comprises an external frame 31 and an enclosure 32.

The external frame is a hollow frame installed in the installing space of the computer system, and the size of the hollow chamber 311 corresponds to the enclosure 32 for their attachment and detachment. The characteristics of the present invention reside on that a slot 313 is disposed at an appropriate position on the rear panel 312 of the external frame 31 for accommodating and positioning a relay connector 1. The signal cable 11*b* has a length of about 50 cm to 100 cm, and the power cable 12*c* has a length of about 20 cm to facilitate the connection. In addition, the power connector 12*b* is a socket with a 12V, a 5V, and two ground (GND) lines totally compatible with the power output connector extended from the power supply, which saves the trouble of installing the adaptor. Therefore, a circuit can be connected through the 12V and 5V terminals of the power supply section 12*a*.

The enclosure is a box body that accommodates a data storage device such as a SATA interface hard disk, and has a through hole 322 corresponding to the relay repeater 11 and allows the relay repeater 11 to pass through for connecting the signal and power connector of the data storage device for the electric connection.

Therefore, through the implementation of this invention, it can greatly reduce production and research and development cost because no circuit board is installed in the relay connector. In addition, a signal cable is directly coupled between the signal section of the relay connector and the signal connector to avoid any signal slow-down or delay situation caused by the circuit layout or circuit connection, and has the expected function of stable high-speed signal transmission. Further, at least one power input connector of this invention can be selectively chosen according to the voltage requirement of the external connecting device to provide the working voltage for the external connecting device. Furthermore, the relay connector fixed in the external frame has the functions of accessing the enclosure, providing portability for the data storage device and the plug-and-play function, which is regarded as a good novel idea for the product of this type.

While the present invention has been described by the most practical and preferred embodiments, it is understood that this invention is not limited to the disclosed embodiments but is intended to cover various arrangements included within the spirit and scope of the broadest interpretations and equivalent arrangements.

What is claimed is:

1. A SATA interface relay connector, comprising a signal section and a power supply section complying with the SATA interface pin assignment, and said signal section being coupled to a signal cable on one side and having a signal connector on one end, and said power supply section being coupled to at least one power input connector on the other side.

2. The SATA interface relay connector of claim 1, wherein said power connector is a 3.3V socket coupled to Pins 1st~3rd of said power supply section.

3. The SATA interface relay connector of claim 1, wherein said power input connector is coupled with said supply section by a power cable.

4. The SATA interface relay connector of claim 3, wherein said power connector is a socket having 12V, 5V, and ground lines respectively coupled to Pins 13th~15th, Pins 7th~9th, and Pins 4th~6th and Pins 10th~12th of said power supply section.

5. The SATA interface relay connector of claim 1, wherein said relay repeater has a protruded ear on both sides for connecting an external connecting device by a connecting member.

6. The SATA interface relay connector of claim 5, wherein said protruded ear has an ear hole for passing said connecting member through.

7. The SATA interface relay connector of claim 1, further comprising a rear panel coupled to an external frame, and said relay connector having a signal section and a power supply section disposed on the inner sides; said signal section at its outer side coupling to a signal cable and at one end having a signal connector; said power supply section at its outer side having a power cable and at one end having a power connector; by means of moving an enclosure in and out of an external frame to connect and disconnect the signal and/or power supply of said relay connector and said enclosure respectively.

8. The SATA interface relay connector of claim 7, wherein said enclosure has a through hole corresponding to said relay connector for passing the relay connector through and receiving the signal of said data storage device and said power connector.

9. The SATA interface relay connector of claim 7, wherein said power connector is a socket with 12V, 5V, and two ground lines.

* * * * *